US010506839B1

(12) United States Patent
Hanson et al.

(10) Patent No.: US 10,506,839 B1
(45) Date of Patent: Dec. 17, 2019

(54) PROTECTIVE HEADGEAR

(71) Applicant: Guardian Innovations, LLC, Peachtree Corners, GA (US)

(72) Inventors: Wallace Lee Hanson, Duluth, GA (US); Erin Nemec Hanson, Duluth, GA (US); Dave Lewandowski, Cumming, GA (US); Caitlin Hanson Gouws, Norcross, GA (US); Alexandra Hanson Garner, Peachtree Corners, GA (US); Matthew Mills Simonds, Atlanta, GA (US)

(73) Assignee: GUARDIAN INNOVATIONS, LLC, Peachtree Corners, GA (US)

( * ) Notice: Subject to any disclaimer, the term of this patent is extended or adjusted under 35 U.S.C. 154(b) by 0 days.

(21) Appl. No.: 15/645,837

(22) Filed: Jul. 10, 2017

Related U.S. Application Data

(60) Provisional application No. 62/359,888, filed on Jul. 8, 2016.

(51) Int. Cl.
*A42B 3/32* (2006.01)
*A42B 3/06* (2006.01)
*A42B 3/12* (2006.01)

(52) U.S. Cl.
CPC ..... *A42B 3/06* (2013.01); *A42B 3/125* (2013.01); *A42B 3/32* (2013.01)

(58) Field of Classification Search
CPC ..... A42B 3/10; A42B 3/32; A42B 1/04
See application file for complete search history.

(56) References Cited

U.S. PATENT DOCUMENTS

| | | | | | |
|---|---|---|---|---|---|
| 3,786,519 | A * | 1/1974 | Aileo | A42B 3/10 | 2/209 |
| 4,843,642 | A * | 7/1989 | Brower | A42B 3/125 | 2/6.6 |
| 5,177,815 | A | 1/1993 | Andujar | | |
| 5,421,035 | A | 6/1995 | Klose et al. | | |
| 5,448,780 | A | 9/1995 | Gath | | |
| 5,544,367 | A * | 8/1996 | March, II | A42B 3/00 | 2/410 |
| 6,021,525 | A | 2/2000 | Mertins | | |
| 6,427,253 | B1 | 8/2002 | Penny | | |
| 8,739,316 | B1 * | 6/2014 | Norton | A42B 1/08 | 2/411 |
| 9,775,394 | B2 * | 10/2017 | Dagan | A42B 3/00 | |
| 2001/0016958 | A1 | 8/2001 | Linday | | |
| 2004/0226077 | A1 * | 11/2004 | Toth | A42B 3/10 | 2/411 |
| 2005/0278832 | A1 * | 12/2005 | Harrington | A42B 3/00 | 2/411 |
| 2015/0342280 | A1 | 12/2015 | James | | |

* cited by examiner

*Primary Examiner* — Tajash D Patel
(74) *Attorney, Agent, or Firm* — BakerHostetler

(57) ABSTRACT

The protective headgear of the present disclosure utilizes closed cell compression molded foam combined with mesh and hook and loop closures and elastic strap that allow the helmet to have a more custom fit than other protective headgear on the market. The three-point adjustment system allows the athlete to fit the size and shape of the headgear both horizontally and vertically to their particular head.

12 Claims, 2 Drawing Sheets

PROTECTIVE HEADGEAR

CROSS-REFERENCE TO RELATED APPLICATIONS

This application is a non-provisional of, and claims priority to, U.S. Provisional Application No. 62/359,888, filed Jul. 8, 2016, the disclosures of which are incorporated herein by reference in their entireties.

TECHNICAL FIELD

This invention relates to the field of protective headgear. More specifically, the invention pertains to adjustable headgear.

BACKGROUND

Protective headgear worn by athletes and sport enthusiasts typically includes some form of padding to prevent injury to the athlete's head. Such injuries can result from a magnitude of athletic activities including football, flag football, 7 on 7 football, rugby, soccer, field hockey, lacrosse, basketball, cycling, or in-line skating etc.

The existing forms of padding are relatively inflexible and are not shaped to bend to the contour of the athlete's head. Further, current protective headgear does not allow for precise adjustment. The athletes are currently unable to adjust their protective headgear to uniquely fit their particular head shape.

There exists a need in the art for protective headgear that allows the athlete to adjust the protective headgear to fit their unique head shape to provide the best fit possible providing maximum protection during athletic events.

SUMMARY

The protective headgear of the present disclosure utilizes closed cell compression molded foam combined with mesh and hook and loop closures and elastic strap that allow the helmet to have a more custom fit than other protective headgear on the market. The three-point adjustment system allows the athlete to fit the size and shape of the headgear both horizontally and vertically to their particular head.

BRIEF DESCRIPTION OF THE DRAWINGS

The following detailed description of preferred embodiments is better understood when read in conjunction with the appended drawings. For the purposes of illustration, there is shown in the drawings exemplary embodiments; however, the subject matter is not limited to the specific elements and instrumentalities disclosed. In the drawings.

DETAILED DESCRIPTION OF ILLUSTRATIVE EMBODIMENTS

Figure 1:
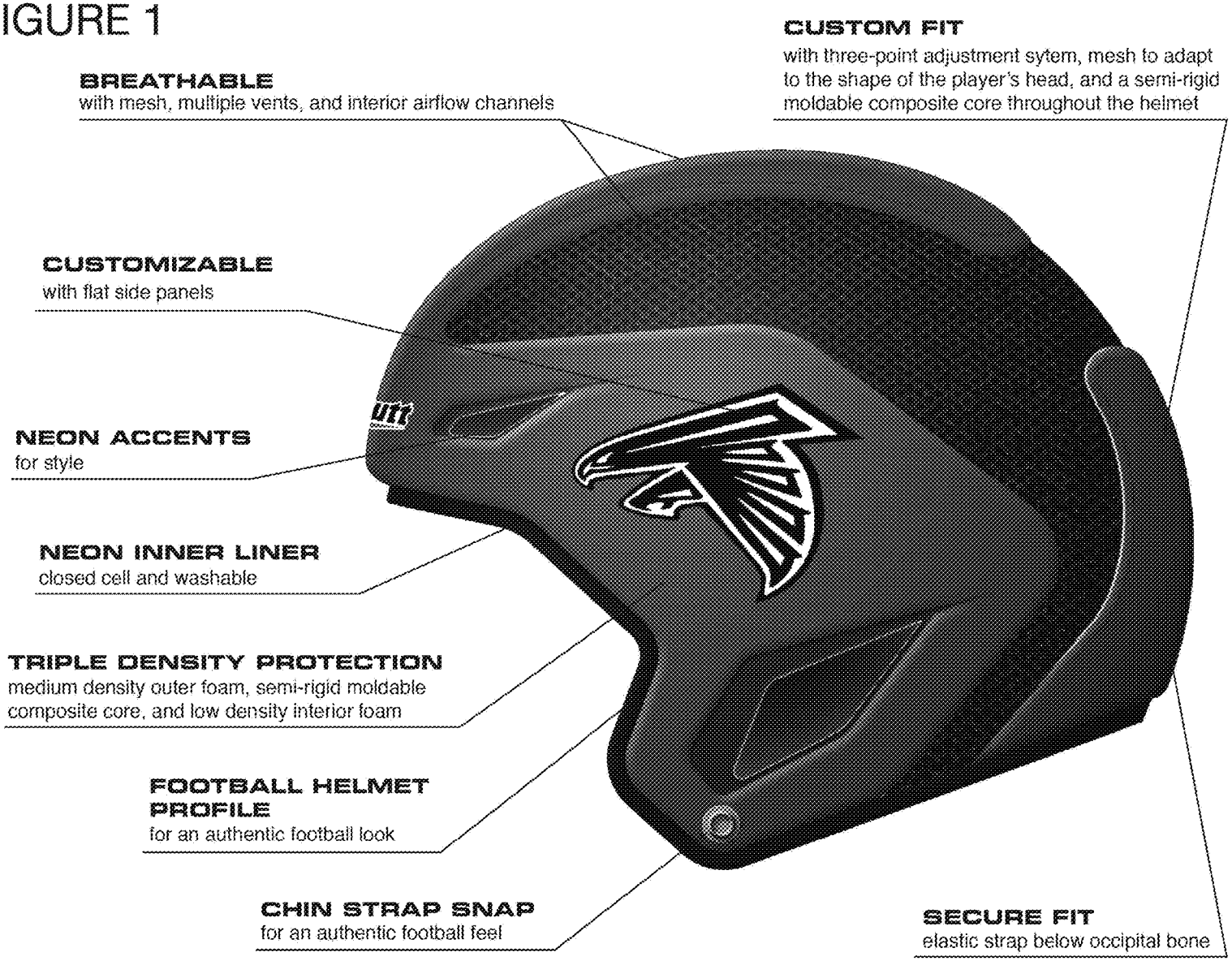
FIG. 1 is a side view of an embodiment of protective headgear in accordance with the present disclosure.

The headgear padding may be comprised of medium density closed cell outer foam, a semi-rigid moldable composite core, and low-density interior foam. The mix of these particular materials allows for the customization to the shape of the athletes head. See FIG. 1.

By connecting multiple pieces of padding to the mesh material it creates a system that adapts to the shape of the athletes head. Another benefit of using this mesh material is that it is breathable. See FIG. 1. It should be understood that the relationship between the mesh and padding is such that various patterns can be deployed to achieve the objectives of the disclosure.

Figure 2:
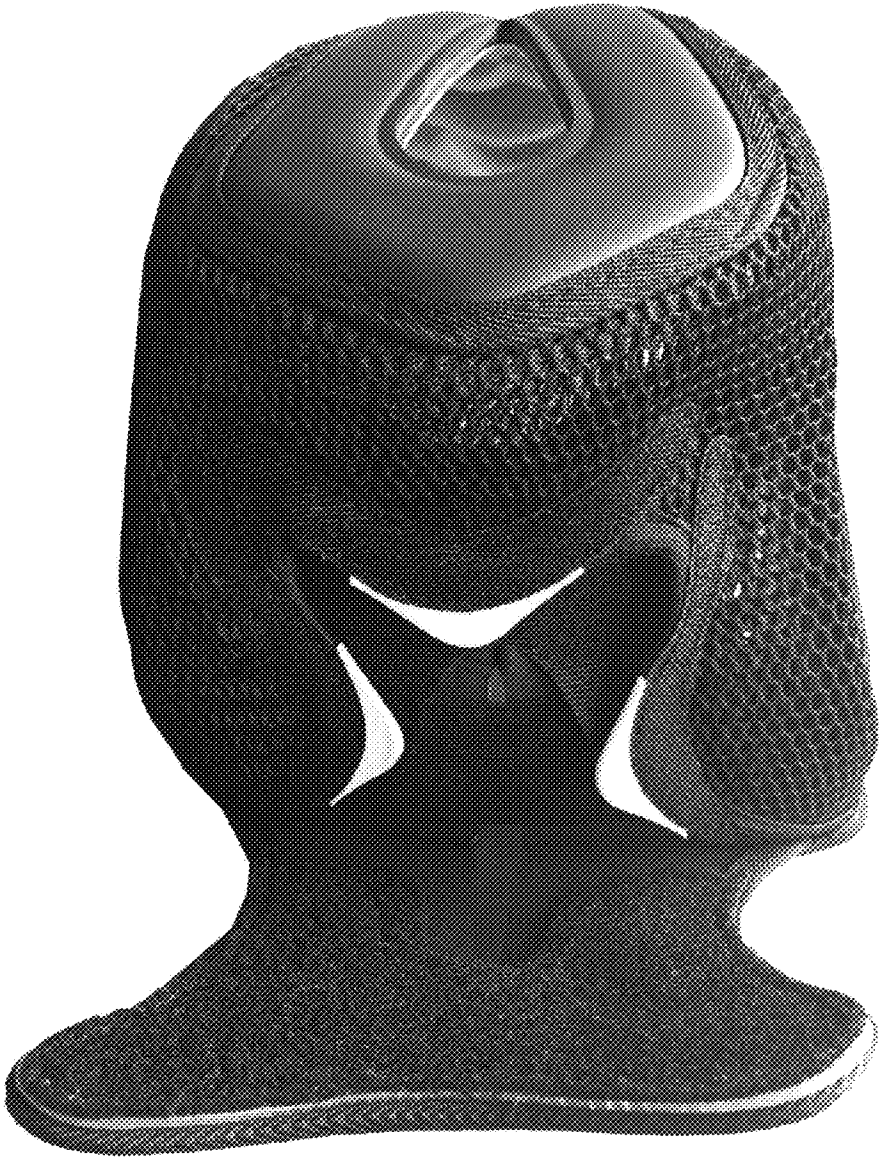
FIG. 2 is a back view of an embodiment of protective headgear showing an adjustable pad open.

The three-point adjustment system of this protective headgear has three hook and loop closure points that can be adjusted horizontally and vertically to secure the headgear to the size and shape of the athletes head. See FIG. 2, in which a pad constructed in accordance with the disclosure is pulled down exposing a Velcro inside surface of the pad. The three point adjustment system is configured such that there is a Velcro adjustment on each side and another at the top. Once those adjustments are made, the pad may then be pulled up and over the adjustable portions and thereby create a headgear that securely fits an athlete while providing protection all around the head area. It should be understood that the adjustment system shown is Velcro but could be any other set/release mechanism.

The interior padding is compression molded creating air flow channels which keep the athlete cool.

The elastic strap on the lower portion of the back piece allows the athlete to take the helmet on and off without having to adjust the fit. Once the helmet is on, it also assists in providing a secure fit by sitting underneath the occipital bone.

What is claimed:

1. An apparatus to protect a head, comprising:

at least one padded section defining a front opening and comprising padding configured to conform to a shape of a head of a wearer;

a mesh section coupled to the at least one padded section;

an adjustable back opening defined by one or more of the mesh section or the at least one padded section; and an adjustment member configured to removably attach to the one or more of the mesh section or the at least one padded section to allow adjustment of a size of the back opening in at least two directions.

2. The apparatus of claim 1, wherein the at least two directions comprise a horizontal direction and a vertical direction.

3. The apparatus of claim 1, wherein the adjustment member comprises an outer pad configured to attach to an outer side of one or more of the mesh section or the at least one padded section to allow adjustment of the size of the back opening.

4. The apparatus of claim 1, further comprising an additional attachment member comprising an inner pad configured to attach to an inner side of one or more of the mesh section or the at least one padded section to allow adjustment of the size of the back opening.

5. The apparatus of claim 1, wherein the padding comprises closed cell compression molded foam.

6. The apparatus of claim 1, wherein the padding comprises an outer foam layer, a semi-rigid moldable composite core, and an inner foam layer having a lower density than a density of the outer foam layer.

7. The apparatus of claim 1, wherein the back opening is defined by the mesh section.

8. The apparatus of claim 1, further comprising one or more adjustment tabs attached to the one of more of the mesh section or the at least one padded section, and wherein the one or more adjustment tabs define a shape of the back opening.

9. The apparatus of claim 8, wherein the one or more adjustment tabs comprise a first adjustment tab defining a top of the opening, a second adjustment tab defining a left side of the opening, and a third adjustment tab defining a right side of the opening.

10. The apparatus of claim 1, further comprising one or more hook and loop closure points configured to attach the adjustment member to the one of more of the mesh section or the at least one padded section defining the back opening.

11. The apparatus of claim 1, wherein the adjustment member comprises one or more elastic straps.

12. The apparatus of claim 1, wherein the back opening is opposite the front opening.

* * * * *